US011514858B2

(12) United States Patent
Kang et al.

(10) Patent No.: US 11,514,858 B2
(45) Date of Patent: Nov. 29, 2022

(54) DISPLAY DEVICE HAVING A DRIVING TRANSISTOR WITH TWO GATE ELECTRODES AND DRIVING METHOD THEREOF

(71) Applicant: LG DISPLAY CO., LTD., Seoul (KR)

(72) Inventors: Min-Gu Kang, Paju-si (KR); SeungChan Choi, Paju-si (KR); Younghyun Ko, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/404,721

(22) Filed: Aug. 17, 2021

(65) Prior Publication Data

US 2022/0189403 A1 Jun. 16, 2022

(30) Foreign Application Priority Data

Dec. 15, 2020 (KR) ..... 10-2020-0175252

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01)

(58) Field of Classification Search
CPC ..... G09G 3/3258
USPC ..... 345/76
See application file for complete search history.

(56) References Cited

U.S. PATENT DOCUMENTS

2010/0053041 A1* 3/2010 Abe ..... G09G 3/325 348/333.01
2017/0337875 A1* 11/2017 Jeon ..... G09G 3/3291
2018/0005575 A1* 1/2018 Lee ..... G09G 3/3233
2020/0135091 A1* 4/2020 Kim ..... G09G 3/3233

* cited by examiner

*Primary Examiner* — Long D Pham
(74) *Attorney, Agent, or Firm* — Morgan, Lewis & Bockius LLP

(57) ABSTRACT

A display device and a driving method for a display device are provided. The display device uses a second storage capacitor and stably moves the threshold voltage of the driving transistor to a positive value in a diode-connected driving circuit. Accordingly, a compensation performance of a threshold voltage of a driving transistor may be improved.

9 Claims, 12 Drawing Sheets

DISPLAY DEVICE HAVING A DRIVING TRANSISTOR WITH TWO GATE ELECTRODES AND DRIVING METHOD THEREOF

CROSS REFERENCE TO RELATED APPLICATION

This application claims priority from Korean Patent Application No. 10-2020-0175252, filed on Dec. 15, 2020, which is hereby incorporated by reference for all purposes as if fully set forth herein.

BACKGROUND

Technical Field

The present disclosure relates to a display device displaying an image and a drying method of a display device.

Discussion of the Related Art

As the information-oriented society has been developed, various needs for display devices for displaying an image have increased. Recently, various types of display devices, such as a Liquid Crystal Display (LCD) device, a Plasma Display Panel (PDP) device, and an Organic Light Emitting display device, have been utilized.

A display device includes a driving circuit including a driving transistor. The driving transistor is driven by applying a data voltage to the top or bottom of the channel layer of the driving transistor using one gate electrode.

In addition, the display device stores and maintains the data voltage for one frame by arranging only one storage capacitor.

SUMMARY

Accordingly, embodiments of the present disclosure are directed to a display device and a driving method thereof that substantially obviates one or more of the problems due to limitations and disadvantages of the related art.

An aspect of the present disclosure is to provide a display device and a driving method thereof to improve a compensation performance of a threshold voltage of a driving transistor.

An aspect of the present disclosure is to provide a display device and a driving method thereof to eliminate a deviation of the reset voltage and prevent an afterimage or residual image occurring during driving.

In one aspect, embodiments of the present disclosure may perform sampling for sensing a sampling voltage using a fast mode in which a driving transistor operates by a sampling voltage stored in one storage capacitor, and perform data writing using a slow mode in which the driving transistor is operated by a data voltage stored in another storage capacitor.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises an organic light-emitting diode; a first transistor supplying a data voltage; a second transistor electrically connected between one of the electrodes of the organic light emitting diode and a driving voltage supply line wherein the second transistor includes a first gate node and a second gate node, and one of a drain node and a source node thereof is electrically connected to the first transistor; a third transistor electrically connected between the other of the source node and the drain node and the first gate node of the second transistor; a fourth transistor electrically connected to the other of the source node and the drain node of the second transistor to apply a driving voltage; a fifth transistor electrically connecting the second transistor and the organic light emitting diode; a sixth transistor supplying a first initialization voltage to one of the source node and the drain node of the fifth transistor and one of the electrodes of the organic light emitting diode; a first storage capacitor electrically connected between the first gate node of the second transistor and one of the electrodes of the organic light emitting diode; a seventh transistor electrically connected to the second gate node of the second transistor; and a second storage capacitor electrically connected between the second gate node of the second transistor and the other of a source node and a drain node of the second transistor.

In another aspect, a driving method for driving a display device comprises diode-connecting between one of the source node and the drain node of the second transistor and the first gate node, and initializing one of the source node and the drain node of the second transistor and the first gate node to a driving voltage; turning the sixth and fifth transistors on to apply a first initialization voltage to the other of the source node and the drain node of the second transistor, and resetting the other of the source node and the drain node of the second transistor to the initialization voltage; in a state in which the third transistor is turned on to and one of the source node and the drain node of the second transistor and the first gate node are diode-connected, turning the first transistor on to apply a data voltage of the second transistor to the other one of the source node and the drain node; and emitting the organic light emitting diode by a driving current of the second transistor corresponding to the data voltage.

According to embodiments of the present disclosure, a display device and a driving method thereof may use a second storage capacitor and stably move the threshold voltage of the driving transistor to a positive value in a diode-connected driving circuit, thereby improving a compensation performance of a threshold voltage of a driving transistor.

According to embodiments of the present disclosure, a display device and a driving method thereof may maintain a reset voltage irrespective of gray, thereby eliminating a deviation of the reset voltage and preventing an afterimage occurring during driving.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles.

DETAILED DESCRIPTION

Figure 1:
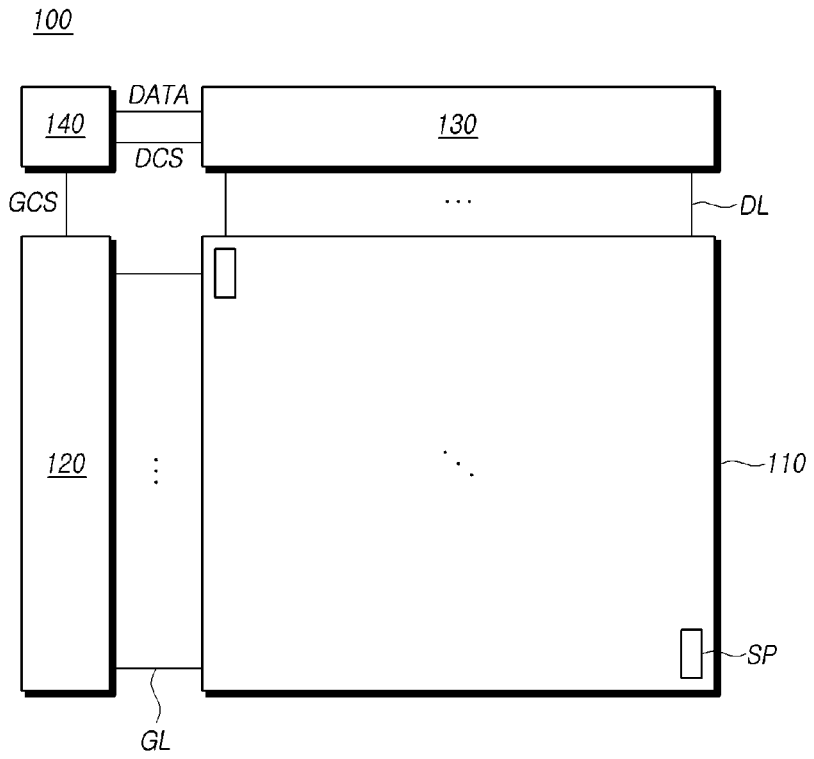
FIG. 1 illustrates a schematic configuration of a display device according to embodiments.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 illustrates a schematic configuration of a display device 100 according to embodiments of the present invention.

Referring to FIG. 1, a display device 100 according to an embodiment includes a display panel 110 in which a plurality of subpixels SP including a light emitting element are arranged, and a gate driving circuit 120, a data driving circuit 130, and a controller 140 for driving the display panel 110.

In the display panel 110, a plurality of gate lines GL and a plurality of data lines DL are disposed. A subpixel SP is disposed in a region where the gate line GL and the data line DL cross each other. Each of these subpixels SP may include a light emitting element, and two or more subpixels SP may constitute one pixel.

The gate driving circuit 120 is controlled by the controller 140, and sequentially outputs scan signals to the plurality of gate lines GL disposed on the display panel 110 to control the driving timing of the subpixels SP.

The gate driving circuit 120 may include one or more gate driver integrated circuits (GDICs), and may be located only on one side of the display panel 110 or both sides according to a driving method.

The data driving circuit 130 receives image data from the controller 140 and converts the image data into an analog data voltage. In addition, the data voltage is output to each data line DL according to a timing when a scan signal is applied through the gate line GL, so that each subpixel SP expresses brightness according to the image data.

The data driving circuit 130 may include one or more source driver integrated circuits (SDICs).

The controller 140 supplies various control signals to the gate driving circuit 120 and the data driving circuit 130, and controls the operation of the gate driving circuit 120 and the data driving circuit 130.

The controller 140 allows the gate driving circuit 120 to output the scan signal according to a timing implemented in each frame. The controller 140 converts the image data received from the outside according to a data signal format used by the data driving circuit 130 and outputs the converted image data to the data driving circuit 130.

The controller 140 receives various timing signals including a vertical synchronization signal Vsync, a horizontal synchronization signal Hsync, an input data enable signal DE, a clock signal CLK, and the like together with the image data from outside (e.g., host system).

The controller 140 may generate various control signals using various timing signals received from the outside and output them to the gate driving circuit 120 and the data driving circuit 130.

For example, in order to control the gate driving circuit 120, the controller 140 outputs various gate control signals including a gate start pulse GSP, a gate shift clock GSC, a gate output enable signal GOE, etc.

Here, the gate start pulse GSP controls an operation start timing of one or more gate driver integrated circuits constituting the gate driving circuit 120. The gate shift clock GSC is a clock signal commonly input to one or more gate driver integrated circuits and controls shift timing of the scan signals. The gate output enable signal GOE specifies timing information of one or more gate driver integrated circuits.

In addition, in order to control the data driving circuit 130, the controller 140 outputs various data control signals including a source start pulse SSP, a source sampling clock SSC, a source output enable signal SOE, etc.

Here, the source start pulse SSP controls the data sampling start timing of one or more source driver integrated circuits constituting the data driving circuit 130. The source sampling clock SSC is a clock signal that controls the sampling timing of data in each of the source driver integrated circuits. The source output enable signal SOE controls the output timing of the data driving circuit 130.

Such a display device 100 supplies various voltages or currents to the display panel 110, the gate driving circuit 120, the data driving circuit 130, or the like. The display device 100 may further include a power management integrated circuit for controlling various voltages or currents to be supplied.

In the display panel 110, in addition to the gate line GL and the data line DL, a voltage line to which various signals or voltages are supplied may be disposed. The light emitting element, a transistor driving the light emitting element, or the like may be disposed in each subpixel SP.

Hereinafter, circuit structures of the subpixel SP and SP1 on the display panel 110 of the display device 100 according to embodiments will be described by an example.

Figure 2:
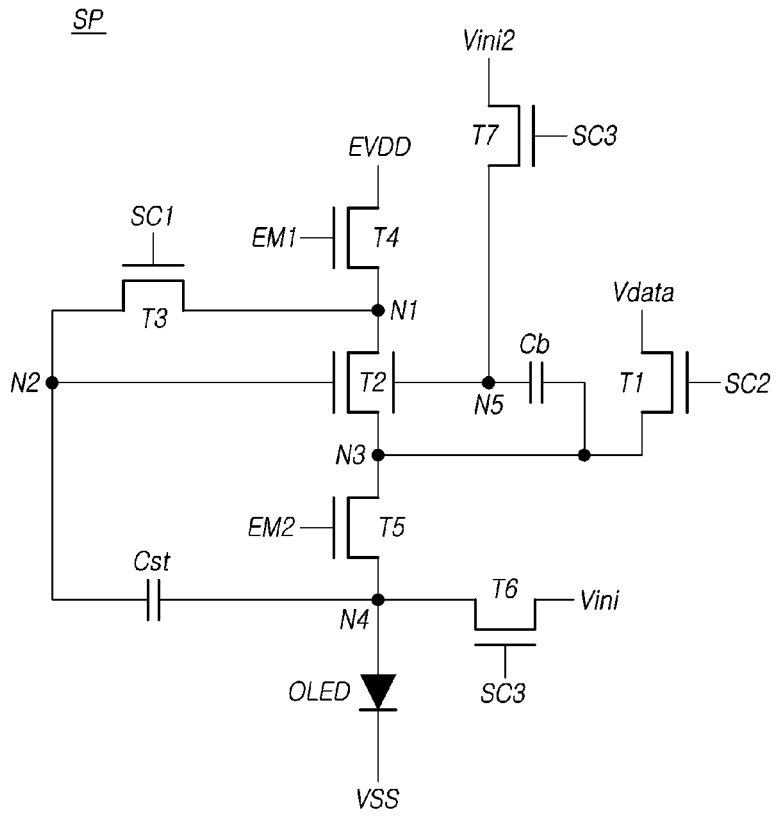
FIG. 2 is a circuit diagram of a subpixel according to an embodiment.

FIG. 2 is a circuit diagram of a subpixel according to an embodiment.

Referring to FIG. 2, a subpixel SP according to an embodiment includes an organic light emitting diode OLED and a driving circuit. The driving circuit includes a first to seventh transistors T1 to T7, a first storage capacitor Cst, and a second storage capacitor Cb, etc. The driving circuit may have a 7T2C structure including seven transistors and two capacitors.

A fourth transistor T4 that is a first enable transistor, a second transistor T2 that is a driving transistor, and a fifth transistor T5 that is a second enable transistor, an organic light-emitting diode OLED are sequentially arranged to a driving voltage supplying line to supply a driving voltage EVDD between the driving voltage EVDD and a base voltage VSS.

The first node N1, the second node N2, the third node N3, and the fourth node N5 of the second transistor T2 may be respectively a drain node, a first gate, a source node, and a second gate node of the second transistor T2, but is not limited thereto. The second transistor T2 is a four-terminal driving transistor including two gate nodes N2 and N5.

The first node N1 and the third node N3 of the second transistor T2 herein are described as a drain node and a source node, but may be a source node and a drain node depending on the type of the second transistor.

The first transistor T1 applies data voltage Vdata to the third node N3 of the second transistor T2 according to the second scan signal SC2. The first transistor T1 is electrically connected to the third node N3 of the second transistor T2, that is, one of a drain node and a source node. The first transistor T1 is turned on and off by the first scan signal SC1 applied to the gate line GL, and controls to apply the data voltage Vdata supplied through the data line DL to the third node N2 of the 2 transistor T2. This first transistor T1 is also referred to as a switching transistor.

The third transistor T3 is electrically connected between the first gate node and the other of the source node and the drain node of the second transistor T2. For example, the third transistor T3 is electrically connected between the first node N1 and the second node N2 of the second transistor T2. The third transistor T3 diode-connects the first node N1 and the second node N2 of the second transistor T2 according to the first scan signal SC1. When the third transistor T3 is turned on by the first scan signal SC1, the other of the source node and the drain node of the second transistor T2 and the first gate node are diode-connected.

The fourth transistor T4 is electrically connected to the other of the source node and the drain node of the second transistor T2 to apply the driving voltage EVDD to the other one of the source node and the drain node of the second transistor T2. For example, the fourth transistor T4 is turned on according to the first enable signal EM1 to supply the driving voltage EVDD to the first node N1 of the second transistor T2.

The fifth transistor T5 electrically connects the second transistor T2 and the organic light emitting diode OLED. The fifth transistor T5 is turned on according to the second enable signal EM2 to electrically connect the second transistor T2 and the organic light-emitting diode OLED, thereby supplying the driving current of the second transistor T2 to the organic light-emitting diodes OLED.

The sixth transistor T6 supplies the first initialization voltage Vini to one of the source node and the drain drain node of the fifth transistor T5 and one of the electrodes of the organic light emitting diode OLED. For example, the sixth transistor T6 supplies the first initialization voltage Vini to the third node N3 of the fifth transistor T5 and the fourth node N4 which is one of the electrodes of the organic light emitting diode OLED. The sixth transistor T6 is turned on according to the third scan signal SC3, and supplies the first initialization voltage Vini to the third node N3 of the fifth transistor T5 and a fourth node N4 that is one of the electrodes of the organic light emitting diode OLED.

The first storage capacitor Cst is electrically connected between the first gate node of the second transistor T2 and one of the electrodes of the organic light emitting diode OLED. For example, the first storage capacitor Cst is electrically connected between the second node N2 and the fourth node N4 of the second transistor T2. The first storage capacitor Cst may maintain the data voltage Vdata applied to the third node N3 of the second transistor DRT for one frame.

The organic light emitting diode OLED represents the brightness according to the difference between the voltage applied to one electrode by the second transistor T2 and the base voltage VSS applied to the other electrode.

The seventh transistor T7 is electrically connected to the second gate node of the second transistor T2. The seventh transistor T7 is electrically connected to the fifth node N5 of the second transistor T2. The seventh transistor T7 is turned on according to the third scan signal SC3 to supply the second initialization voltage Vini2 to the fifth node N5, which is the second gate node.

The second storage capacitor Cb is electrically connected between the second gate node of the second transistor T2 and the other of the source node and the drain node of the second transistor T2. The second storage capacitor Cb is electrically connected between the fifth node N5 and the third node N3 of the second transistor T2. The second storage capacitor Cb may be built into the second transistor T2 or may be configured externally.

At least two of the gates of the first transistor T1 as the switching transistor, the third transistor T3, the sixth transistor T6, and the seventh transistor T7 may be electrically connected or integrally configured. For example, as shown in FIG. 2, the gates of the sixth transistor T6 and the seventh transistor T7 may be electrically connected or integrally configured. Accordingly, the sixth transistor T6 and the seventh transistor T7 may be turned on or turned off according to the same scan signal.

In addition, at least one of the gates of the first transistor T1, the third transistor T3, the sixth transistor T6, and the seventh transistor T7 may also be electrically connected to at least one of the gates of a fourth transistor T4 as enable transistor and the fifth transistor T5 or integrally configured with at least one of the gates of a fourth transistor T4 as enable transistor and the fifth transistor T5.

Hereinafter, with reference to a partial cross-sectional view of the second transistor 2T and the seventh transistor T7 of FIG. 2, the cross-sectional structure of the second transistor T2 using a 4-terminal oxide transistor, and the connection relationship between the second transistor T2 and the seventh transistor T7 will be described.

Figure 3:
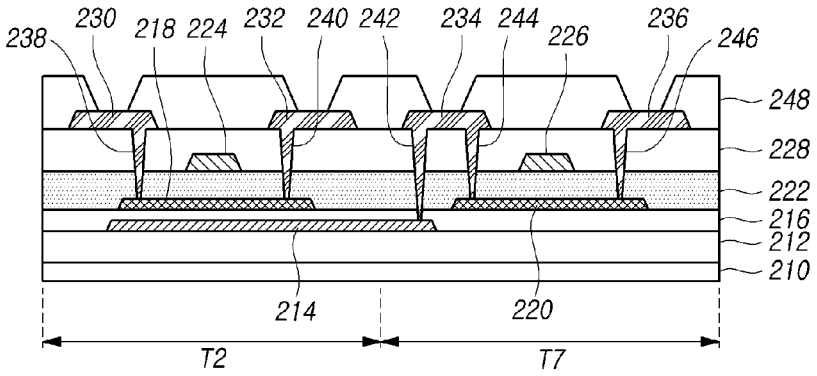
FIG. 3 is a partial cross-sectional view of a driving transistor and a fourth transistor of FIG. 2.

FIG. 3 is a partial cross-sectional view of a second transistor and a seventh transistor of FIG. 2.

Referring to FIG. 3, a first insulating layer 212 is disposed on a substrate 210, and a second gate electrode 214 is patterned on the first insulating layer 212 at a position corresponding to the second transistor T2. The second gate electrode 214 corresponds to the second gate node N5 of FIG. 2.

A second insulating layer 216 is disposed on the first insulating layer 212 patterned with the second gate electrode 214, and an oxide semiconductor layers 218 and 220 are disposed on the second insulating layer 216 at positions corresponding to the second transistor T2 and a seventh transistor T7. The oxide semiconductor layers 218 and 220 constitute a channel layer of the second transistor T2 and the seventh transistor T7. The oxide semiconductor layers 218 and 220 are exemplarily described as channel layers, but may be other types of semiconductor layers.

A gate insulating layer 222 is disposed on the second insulating layer 216 on which the oxide semiconductor layers 218 and 220 are patterned, and the first gate electrode 224 of the driving transistor and the gate electrode 226 of the seventh transistor T7 are patterned at the position corresponding to the second transistor T2 and the seventh transistor T7. The first gate electrode 224 corresponds to the first gate node N1 of FIG. 2.

An interlayer insulating layer 228 is disposed on the gate insulating layer 222 in which the first gate electrode 224 of the second transistor T2 and the gate electrode 226 of the seventh transistor T7 are patterned. Source/drain electrodes 230 and 232 of the second transistor T2 and source/drain electrodes 234 and 236 of the seventh transistor T7 are disposed on the interlayer insulating layer 228.

The source/drain electrodes 230 and 232 of the second transistor T2 contacts with the source region and the drain region of the oxide semiconductor layer 218 through a first contact hole 238 and a second contact hole 240 passing through the interlayer insulating layer 228 and the gate insulating layer 222.

One 234 of the source/drain electrodes 234 and 236 of the seventh transistor T7 contacts with the second gate electrode 224 through the third contact hole 242 passing through the interlayer insulating layer 228, the gate insulating layer 222, and the second insulating layer 216. As a result, the second gate node N5 is electrically connected to the seventh transistor T7 through the third contact hole 242.

The source/drain electrodes 234 and 236 of the seventh transistor T7 contacts with the source region and the drain region of the oxide semiconductor layer 220 through a fourth contact hole 244 and a fifth contact hole 246 passing through the interlayer insulating layer 228 and the gate insulating layer 222, respectively.

A planarization layer 248 is disposed on the interlayer insulating layer 228. Layers forming the organic light-emitting diode OLED (not shown) is disposed on the planarization layer 248.

As shown in FIG. 3, only the gate electrode 226 is disposed on the oxide semiconductor layer 218 of the seventh transistor T7. In the second transistor T2, a first gate electrode 224 and a second gate electrode 214 are disposed above and below the oxide semiconductor layer 218. In addition, the second gate electrode 214 of the second transistor T2 is electrically connected to one 234 of the source/drain electrodes 234 and 236 of the seventh transistor T7 through the third contact hole 242.

In the second transistor T2, the capacitance of the second insulating layer 216 between the oxide semiconductor layer 218 and the second gate electrode 214 is may be smaller than the capacitance of the gate insulating layer 222 between the oxide semiconductor layer 218 and the first gate electrode 224. The capacitance is proportional to the dielectric constant of the dielectric and inversely proportional to the thickness thereof.

As an example, the thickness of the second insulating layer 216 between the oxide semiconductor layer 218 and the second gate electrode 214 in the second transistor T2 is may be thinner the thickness of the gate insulating layer 222 between the oxide semiconductor layer 218 and the first gate electrode 224.

As another example, the dielectric constant of the second insulating layer 216 between the oxide semiconductor layer 218 and the second gate electrode 214 in the second transistor T2 may be smaller than the dielectric constant of the gate insulating layer 222 between the oxide semiconductor layer 218 and the first gate electrode 224. That is, the dielectric constant of the material used as the second insulating layer 216 may be smaller than the dielectric constant of the material used as the gate insulating layer 222.

As described with reference to FIG. 3, a first gate electrode 224 as a first gate node is located on an oxide semiconductor layer 218 that is a channel layer of a second transistor T2, and a second gate electrode 214 as a second gate node is located under the oxide semiconductor layer 218 that is a channel layer of the driving transistor. The second gate electrode 214 is electrically connected to the second node of the fourth transistor T4 through the third contact hole 242.

As another example, the first gate electrode 224 as a first gate node is located under an oxide semiconductor layer 218 that is a channel layer of a second transistor T2, and a second gate electrode 214 as a second gate node is located on the oxide semiconductor layer 218 that is a channel layer of the second transistor T2.

In this case, the gate insulating layer 222 is located between the oxide semiconductor layer 218 and the second gate electrode 214 in the second transistor T2, and the second insulating layer 216 is located between the oxide semiconductor layer 218 and the first gate electrode 224. Therefore, the capacitance of the gate insulating layer 222 between the oxide semiconductor layer 218 and the second gate electrode 214 may be smaller than the capacitance of the second insulating layer 216 between the oxide semiconductor layer 218 and the first gate electrode 224. As mentioned above, the capacitance is proportional to the dielectric constant of the dielectric and inversely proportional to the thickness.

As an example, the thickness of the gate insulating layer 222 between the oxide semiconductor layer 218 and the second gate electrode 214 in the second transistor T2 may be thinner that of the oxide semiconductor layer 218 and the first gate electrode 224 the second insulating layer 216.

As another example, the dielectric constant of the gate insulating layer 222 between the oxide semiconductor layer 218 and the second gate electrode 214 in the second transistor T2 may be smaller than the dielectric constant of the second insulating layer 216 between the oxide semiconductor layer 218 and the first gate electrode 224. The dielectric constant of the material used as the gate insulating layer 222 may be smaller than the dielectric constant of the material used as the second insulating layer 216.

In general, if only the first gate electrode 224 is disposed above or below the oxide semiconductor layer 218 without the second gate electrode 214, the second transistor T2 has a small S-factor so that the data voltage margin for displaying the gray area may be small.

In addition, in general, when only the first gate electrode 224 is disposed above or below the oxide semiconductor layer 218 without the second gate electrode 214, the second transistor T2 of a diode-connected method may not operate if the threshold voltage Vth is a negative polarity less than 0V.

The second transistor T2 according to the above-described embodiment may utilize the advantages of four terminals oxide transistor including the oxide semiconductor layer 218, the first gate electrode 224, the oxide semiconductor layer 218, and the second gate electrode 214, thereby improving the S-factor, and positively move the threshold voltage Vth of the diode-connected second transistor T2, thereby improving compensation performance. The S-factor or sub-threshold swing expresses the characteristic of generating a leakage current by applying a voltage lower than the threshold voltage Vth, and affects the device performance (E.g., mobility, on-current characteristics, etc.) of the transistor along with the channel length.

Driving methods for driving the subpixel SP of FIG. 2 may be various. Hereinafter, an example of a driving method for driving the subpixel SP of FIG. 2 will be described with reference to FIGS. 4 to 7.

Figure 4:
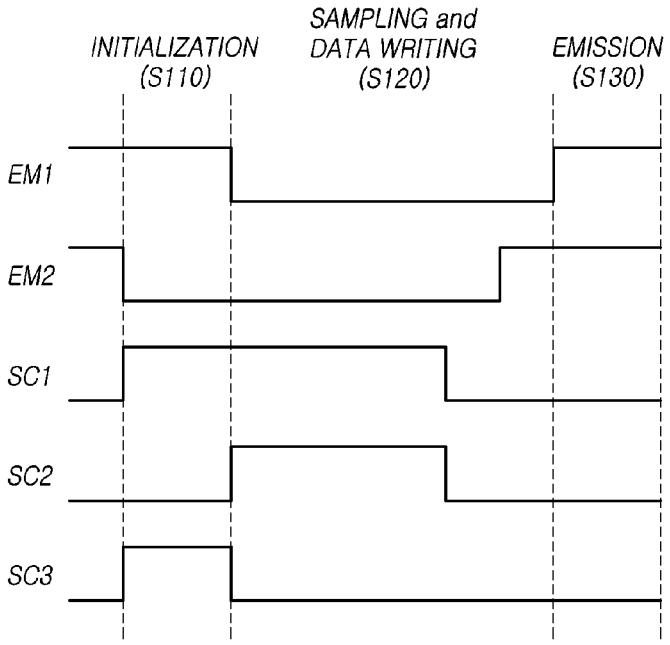
FIG. 4 is a timing diagram of driving the subpixel of FIG. 2.
Figure 5:
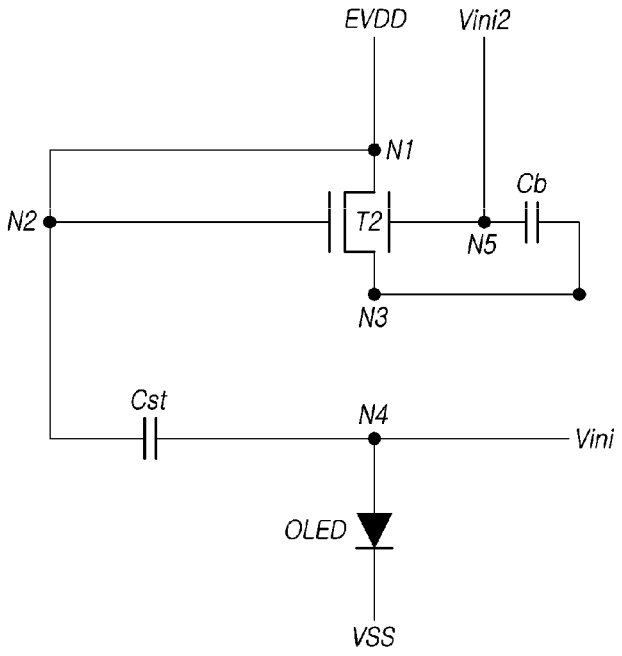
FIGS. 5 to 7 are circuit diagrams of the subpixel of FIG. 2 in the initialization step, the sampling and data writing step, and the light emission step of FIG. 4.
Figure 6:
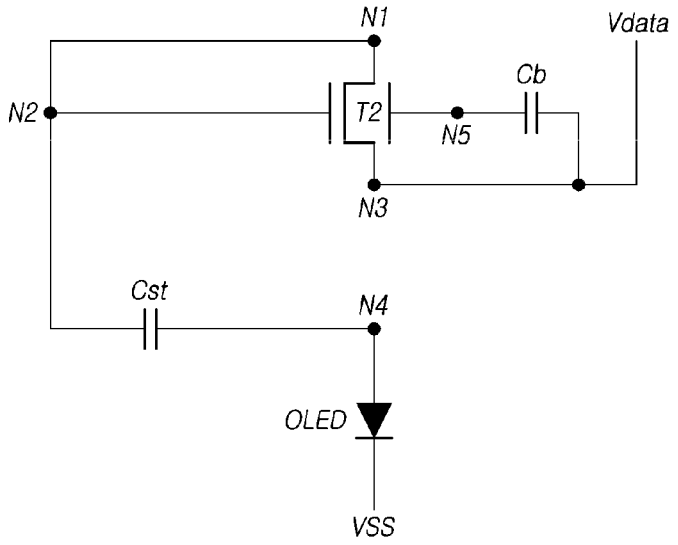
Figure 7:
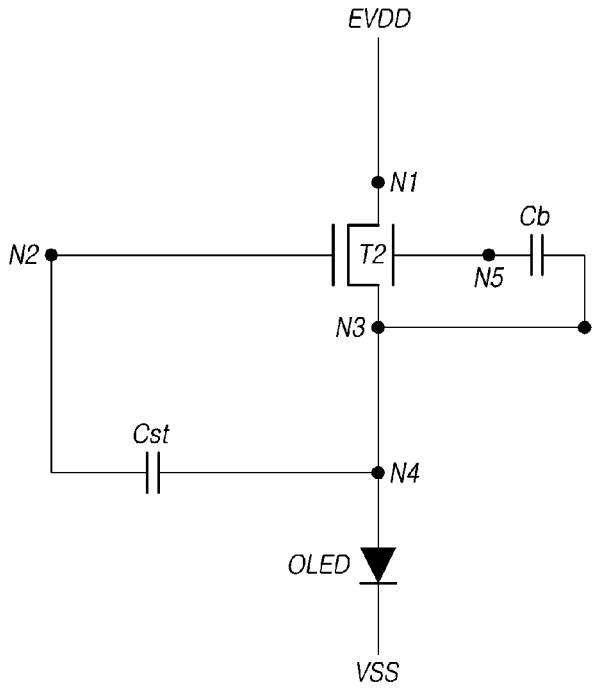

FIG. 4 is a timing diagram of driving the subpixel of FIG. 2. FIGS. 5 to 7 are circuit diagrams of the subpixel of FIG. 2 in the initialization step, the sampling and data writing step, and the light emission step of FIG. 4.

Referring to FIG. 4, the driving method of driving the subpixel SP of FIG. 2 includes an initialization step S110 of initializing nodes N1, N2 and N5 of the second transistor, a sampling and data writing step S120 sensing the characteristic value (e.g., threshold voltage) or a sampling voltage related to the characteristic value of the second transistor T2 and input data, and an light emission step S130 of emitting an organic light-emitting diode OLED.

Referring to FIGS. 4 and 5, in the initialization step S110, the fourth transistor T4 is turned on according to the first enable signal EM1 so that the driving voltage EVDD may be applied to the first node N2 of the second transistor T2.

The third transistor T3 is turned on according to the first scan signal SC1 so that the first node N1 and the second node N2 of the second transistor T2 may be diode-connected.

The seventh transistor T7 is turned on according to the third scan signal SC3 so that the second initialization voltage Vini is applied to the fifth node N5 of the second transistor T2. Accordingly, a constant voltage related to the second initialization voltage Vini is formed in the second storage capacitor Cb between the third node N3 and the fifth node N5 of the second transistor T2.

The fifth transistor T5 is turned on according to the third scan signal SC3 so that the first initialization voltage Vini is applied to the fourth node N4. Accordingly, the gate-source voltage (Vgs=EVDD−Vini) of the second transistor T2 is charged in the first storage capacitor Cst.

Referring to FIGS. 4 and 6, in the sampling and data writing step S120, the third transistor T3 is turned on according to the first scan signal SC1 so that, at a state in which the first node N1 and the second node N2 of the second transistor T2 are diode-connected, the first transistor T1 is turned on according to the second scan signal SC2 to apply the data voltage Vdata to the third node N3.

In this case, since the data voltage Vdata is applied to the third node N3 of the second transistor T2 at the state in which the first node N1 and the second node N2 of the second transistor T2 are diode-connected, the voltage of the fifth node N5 is also varied by the data voltage Vdata so as to maintain the constant voltage charged in the second storage capacitor Cb.

That is, the threshold voltage of the second transistor T2 for each gray applied to the third node N3 is constantly shifted to a positive value by utilizing maintaining the constant voltage charged in the second storage capacitor Cb.

Referring to FIGS. 4 and 7, in the light emission step S130, the fourth transistor T4 and the fifth transistor T5 according to the first and second enable signals EM1 and EM2 is turned on so that a driving current corresponding to the gray display signal voltage charged in the first storage capacitor Cst flows into the organic light emitting diode OLED, and the organic light emitting diode OLED emits light with gray brightness.

The second transistor T2 according to the above-described embodiment stably moves the threshold voltage of the second transistor T2 to a positive value in a diode-connected driving circuit using the second storage capacitor Cb, thereby improving compensation performance of the second transistor T2.

Figure 8:
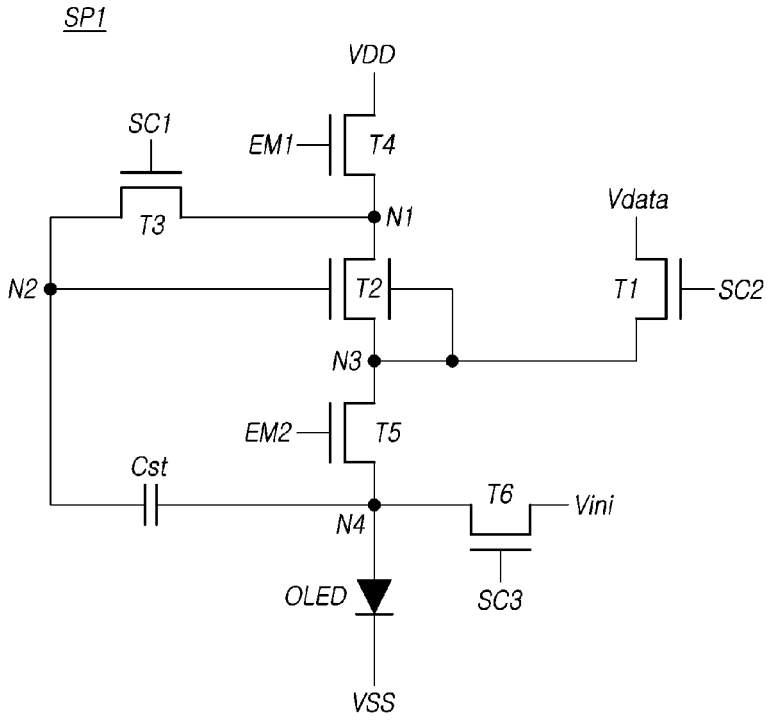
FIG. 8 is a circuit diagram of a subpixel according to another embodiment.

FIG. 8 is a circuit diagram of a subpixel according to another embodiment.

Referring to FIG. 8, a subpixel SP1 according to another embodiment includes an organic light emitting diode OLED, and a driving circuit including first to sixth transistors T1-T6, a first storage capacitor Cst and the like. That is, the driving circuit may have a 6T1C structure including six transistors and one capacitor.

The first to sixth transistors T1-T6 and the first storage capacitor Cst of the subpixel SP1 according to another embodiment may be substantiality the same as the first to sixth transistors T1 to T6 and the first storage capacitor Cst of the subpixel SP according to the embodiment described with reference to FIG. 2 in view of a driving circuit. However, the subpixel SP1 according to another embodiment does not include the seventh transistor T7 and the second storage capacitor Cb of the subpixel SP according to the embodiment described with reference to FIG. 2.

Specifically, the fourth transistor T4, the second transistor T2 which are driving transistors, the fifth transistor T5, and the organic light emitting diode OLED are sequentially arranged between the driving voltage EVDD and the base voltage VSS. The second transistor T2 is a four-terminal driving transistor including two gate nodes N2 and N5.

The first transistor T1 controls the data voltage Vdata supplied through the data line DL to be applied to the third node N2 of the second transistor T2. When the third transistor T3 is turned on according to the first scan signal SC1, the second transistor T2 is diode-connected and operates like a diode. The fourth transistor T4 is turned on according to the first enable signal EM1 to supply the driving voltage EVDD to the first node N1 of the second transistor T2. The fifth transistor T5 is turned on according to the second enable signal EM2 to connect the second transistor T2 and the organic light-emitting diode OLED and supply the driving current of the second transistor T2 to the organic light emitting diode OLED.

The sixth transistor T6 is turned on according to the third scan signal SC3 to supply the initialization voltage Vini to one of the source and the drain of the fifth transistor T5 and the node N4, which is the same node of one of the electrodes of the organic light emitting diode OLED.

The first storage capacitor Cst may maintain the data voltage Vdata applied to the third node N3 of the second transistor DRT for one frame.

At least two of the gates of the first transistor T1 which is a switching transistor, the third transistor T3, and the sixth transistor T6 may be electrically connected or integrally configured.

In addition, at least one of the gates of the first transistor T1, the third transistor T3, the sixth transistor T6, and the seventh transistor T7, and at least one of the gates of a fourth transistor T4 and the fifth transistor T5 which are enable transistors may also be electrically connected or integrally configured.

There may be various driving methods for driving the subpixel SP1 of FIG. 8. Hereinafter, an example of a driving method for driving the subpixel SP1 of FIG. 8 will be described with reference to FIG. 9.

Figure 9:
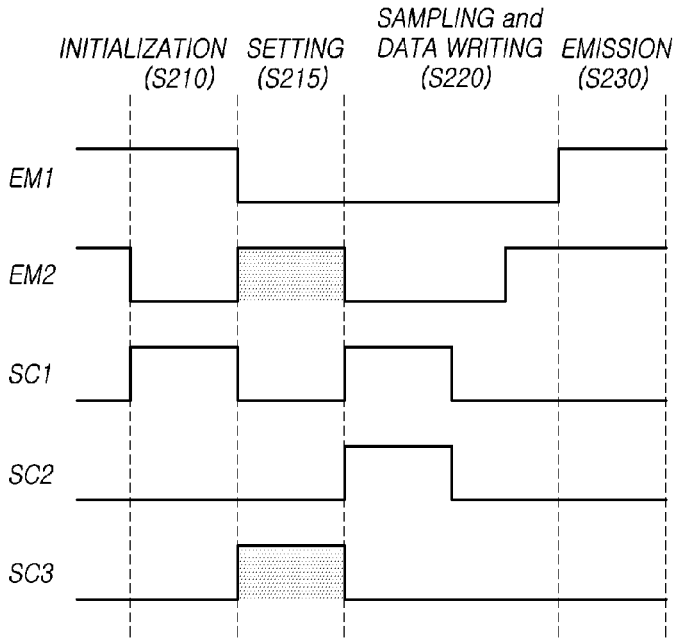
FIG. 9 is a timing diagram of driving the subpixel SP1 of FIG. 8.
Figure 10:
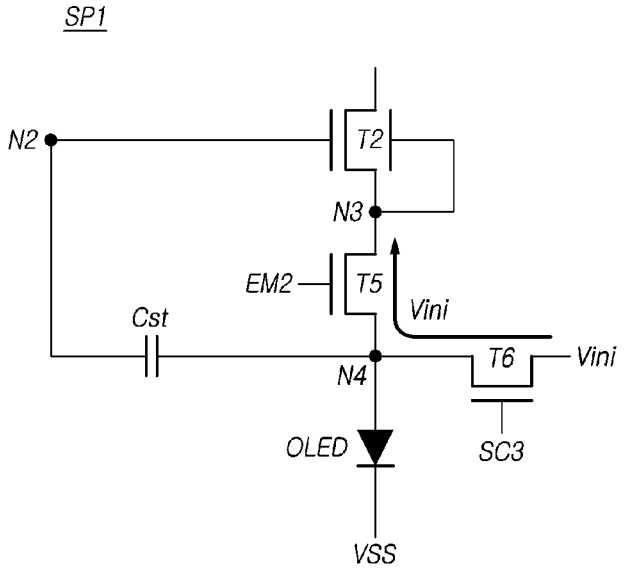
FIG. 10 is a circuit diagram of resetting one of a source node and a drain node of a second transistor to an initialization voltage in the setting step of FIG. 9.

FIG. 9 is a timing diagram of driving the subpixel SP1 of FIG. 8. FIG. 10 is a circuit diagram of resetting one of a source node and a drain node of a second transistor to an initialization voltage in the setting step of FIG. 9.

Referring to FIG. 9, the driving method of driving the subpixel SP1 of FIG. 8 includes an initialization step S210 of initializing the first and second nodes N1 and N2 of the second transistor T2, a setting step S215 of resetting the third node N3 of the second transistor T2, a sampling and data writing step S220 of sensing a characteristic value and a sampling voltage related to the characteristic value of the second transistor T2 and inputting data, a light emission step S230 of emitting the organic light emitting diode OLED.

Referring to FIG. 9, in the initialization step S210, the fourth transistor T4 is turned on according to the first enable signal EM1 so that the driving voltage EVDD is applied to the first node N2 of the second transistor T2.

The third transistor T3 is turned on according to the first scan signal SC1 so that the first node N1 and the second node N2 of the second transistor T2 are diode-connected. Through this, the first and second nodes N1 and N2 of the second transistor T2 are initialized to the driving voltage EVDD.

Referring to FIGS. 9 and 10, in the setting step S215, the sixth transistor T6 and the fifth transistor T5 are turned on so that the initialization voltage Vini is applied to the other of the source node and the drain node of the second transistor T2, and the other of the source node and the drain node of the second transistor T3 is reset to the initialization voltage. Meanwhile, the other of the source node and the drain node of the second transistor T3 reset to the initialization voltage Vini is the same node as the second gate node of the second transistor T2.

For example, the fifth transistor T5 is turned on according to the third scan signal SC3 to apply the initialization voltage Vini to the fourth node N4. The fifth transistor T5 is turned on according to the second enable signal EM2. Accordingly, the third node N3 of the second transistor T3 is reset to the initialization voltage Vini.

In the sampling and data writing step S220, the third transistor T3 is turned on according to the first scan signal SC1 so that the first node N1 and the second node of the second transistor T2 N2 is diode-connected.

The first transistor T1 is turned on according to the second scan signal SC2 so that the data voltage Vdata is applied to the third node N3.

Thereafter, the fifth transistor T5 is turned on according to the second enable signal EM2, and the gray display signal voltage, which is the data voltage Vdata, is maintained in the storage capacitor Cst for one frame.

In the light emission step S230, the fourth transistor T4 and the fifth transistor T5 are turned on according to the first and second enable signals EM1 and EM2 so that a driving current corresponding to the gray display signal voltage charged in the first storage capacitor Cst flows into the organic light emitting diode OLED, and the organic light emitting diode OLED emits light with gray brightness.

In the setting step S215 of the second transistor T2 according to the above-described embodiment, the fifth transistor T5 is turned on according to the third scan signal SC3 so that the third node N3 of the second transistor T3 is reset to the initialization voltage Vini and the reset voltage is maintained irrespective of gray such as black data or white data, thereby eliminating a deviation of the reset voltage and preventing an afterimage from occurring during driving.

For example, when the third node of the second transistor T2 is reset by using the data voltage Vdata as the initialization voltage Vini and the data is white data, the third node N3 of the second transistor T2 is reset to a high voltage (e.g., 5V). In this case, when the data is black data, the third node of the second transistor T2 is reset to a low voltage (e.g., 0.5V) equal to or lower than the data voltage corresponding to the black data. That is, due to the difference in the applied data voltages such as the high voltage (e.g., 5V) and a low voltage (e.g., 0.5V), a deviation in the reset voltage may be caused, and accordingly, an afterimage or residual image may occur in 1 Hz driving.

However, since the second transistor T2 according to the above-described embodiment performs a reset by using a low initialization voltage of the black data level instead of the data voltage, the deviation of the reset voltage may be eliminated and the afterimage may be reduced or improved in 1 Hz driving.

In the driving method of driving the subpixel SP1 of FIG. 9, the third node of the second transistor T2 may be reset with the initialization voltage Vini, but the initialization voltage Vini may reset one of the source node and the drain node of the driving transistor corresponding to the second transistor T2. Hereinafter, resetting one of the source node and the drain node of the driving transistor corresponding to the second transistor T2 with the first initialization voltage Vini for the subpixel SP of FIG. 2 will be described.

Figure 11:
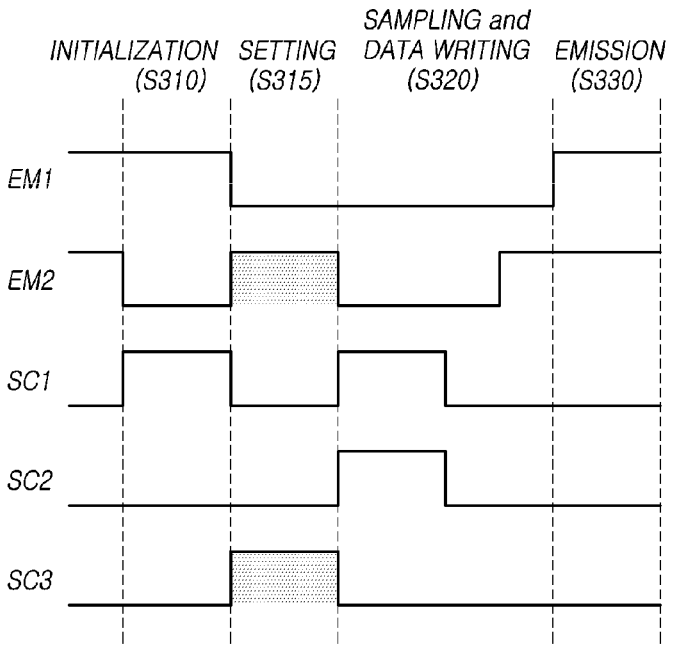
FIG. 11 is a timing diagram of driving the subpixel SP of FIG. 2 as another example.
Figure 12:
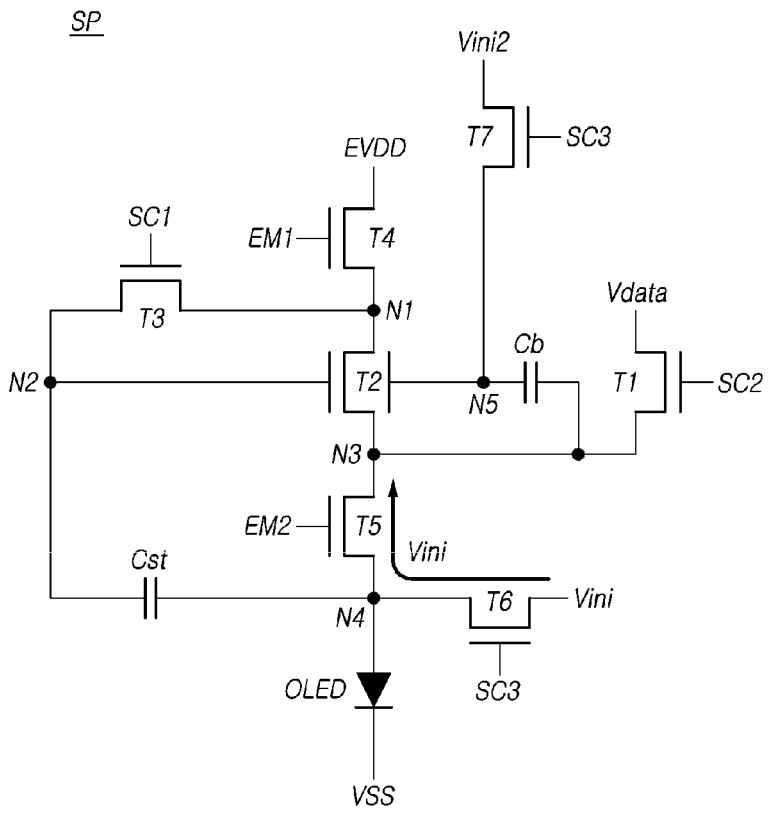
FIG. 12 is a circuit diagram of resetting one of a source node and a drain node of a second transistor with an initialization voltage in the setting step of FIG. 11.

FIG. 11 is a timing diagram of driving the subpixel SP of FIG. 2 as another example. FIG. 12 is a circuit diagram of resetting one of a source node and a drain node of a second transistor with an initialization voltage in the setting step of FIG. 11.

Referring to FIG. 11, the driving method of driving the subpixel SP of FIG. 2 includes an initialization step S310 of initializing the first and second nodes N1 and N2 of the second transistor T2, a setting step S315 of resetting the third node N3 of the second transistor T2, a sampling and data writing step S320 of sensing a characteristic value or a sampling voltage related to the characteristic value of the second transistor T2 and inputting data, the light emission step S330 of emitting the organic light emitting diode OLED.

The initialization step 310, the sampling and data writing step S320, and the light emitting step S330 may be substantially the same as the initialization step 110, the sampling and data writing step S120, and the light emitting step S130 described with reference to FIGS. 4 to 7.

Referring to FIGS. 11 and 12, in the setting step S315, the sixth transistor T6 and the fifth transistor T5 are turned on so that the first initialization voltage Vini is applied to the other of the source node and the drain node of the second transistor T2, and the other of the source node and the drain node of the second transistor T2 is reset to the first initialization voltage Vini. The other of the source node and the drain node of the second transistor T2 reset to the initialization voltage Vini may be the same node as one of the nodes of the second storage capacitor Cb.

For example, the fifth transistor T5 is turned on according to the third scan signal SC3 to apply the initialization voltage Vini to the fourth node N4. The fifth transistor T5 is turned on according to the second enable signal EM2. Accordingly, the third node N3 of the second transistor T3 is reset to the first initialization voltage Vini.

In the sub-pixel SP according to the embodiment described with reference to FIG. 2, in the setting step S315, the fifth transistor T5 is turned on according to the third scan signal SC3 so that the third node N3 of the second transistor T3 is reset to the initialization voltage Vini and the reset voltage is maintained irrespective of gray such as black data or white data, thereby eliminating a deviation of the reset voltage and preventing an afterimage from occurring during driving.

That is, since the subpixel SP according to the embodiment described with reference to FIG. 2 also performs a reset by using a low initialization voltage of the black data level instead of the data voltage, the deviation of the reset voltage may be eliminated and the afterimage may be reduced or improved in 1 Hz driving.

It will be apparent to those skilled in the art that various modifications and variations can be made in the display device and the driving method thereof of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device comprising:

an organic light emitting diode;

a first transistor for supplying a data voltage;

a second transistor electrically connected between one of electrodes of the organic light emitting diode and a driving voltage supply line wherein the second transistor includes a first gate node and a second gate node, and one of a drain node and a source node thereof is electrically connected to the first transistor;

a third transistor electrically connected between the other of the source node and the drain node and the first gate node of the second transistor;

a fourth transistor electrically connected to the other of the source node and the drain node of the second transistor to apply a driving voltage;

a fifth transistor electrically connecting the second transistor and the organic light emitting diode;

a sixth transistor for supplying a first initialization voltage to one of the source node and the drain node of the fifth transistor and one of the electrodes of the organic light emitting diode;

a first storage capacitor electrically connected between the first gate node of the second transistor and one of the electrodes of the organic light emitting diode;

a seventh transistor electrically connected to the second gate node of the second transistor; and a second storage capacitor electrically connected between the second gate node of the second transistor and one of the source node and the drain node of the second transistor, wherein the second gate node of the second transistor is electrically connected to the seventh transistor through a contact hole.

2. The display device of claim 1, wherein the first gate node is located above or below a channel layer of the second transistor, when the first gate node is located above the channel layer of the second transistor, the second gate node is located below the channel layer of the second transistor, and when the first gate node is located below the channel layer, the second gate node is located above the channel layer of the second transistor.

3. The display device of claim 1, wherein the seventh transistor is turned on so that a second initialization voltage is applied to the second gate node of the second transistor T2 and a constant voltage related to the second initialization voltage is formed on the second storage capacitor, in a state in which the third transistor is turned on so that the first gate node of the second transistor and the other of the source node and the drain node are diode-connected, the first transistor is turned on so that the data voltage is applied to one of the source node and the drain node of the second transistor.

4. The display device of claim 3, wherein before the first transistor is turned on so that the data voltage is applied to the other of the source node and the drain node of the second transistor, the sixth and fifth transistors are turned on so that the first initialization voltage is applied to the other one of the source node and the drain node of the second transistor.

5. A display device comprising:

an organic light emitting diode;

a first transistor for supplying a data voltage;

a second transistor electrically connected between one of electrodes of the organic light emitting diode and a driving voltage supply line wherein the second transistor includes a first gate node and a second gate node, and one of a drain node and a source node thereof is electrically connected to the first transistor;

a third transistor electrically connected between the other of the source node and the drain node and the first gate node of the second transistor;

a fourth transistor electrically connected to the other of the source node and the drain node of the second transistor to apply a driving voltage;

a fifth transistor electrically connecting the second transistor and the organic light emitting diode;

a sixth transistor for supplying a first initialization voltage to one of the source node and the drain node of the fifth transistor and one of the electrodes of the organic light emitting diode;

a first storage capacitor electrically connected between the first gate node of the second transistor and one of the electrodes of the organic light emitting diode;

a seventh transistor electrically connected to the second gate node of the second transistor; and a second storage capacitor electrically connected between the second gate node of the second transistor and one of the source node and the drain node of the second transistor, wherein gates of the sixth transistor and the seventh transistor are electrically connected or integrally formed, so that the sixth transistor and the seventh transistor are turned on or off according to a same scan signal.

6. A driving method for driving a display device comprising an organic light emitting diode, a first transistor supplying a data voltage, a second transistor electrically connected between one of electrodes of the organic light emitting diode and a driving voltage supply line wherein the second transistor includes a first gate node and a second gate node, and one of a drain node and a source node thereof is electrically connected to the first transistor, a third transistor electrically connected between the other of the source node and the drain node and the first gate node of the second transistor, a fourth transistor electrically connected to the other of the source node and the drain node of the second transistor to apply a driving voltage, a fifth transistor electrically connecting the second transistor and the organic light emitting diode, a sixth transistor supplying a first initialization voltage to one of a source node and a drain node of the fifth transistor and one of the electrodes of the organic light emitting diode, a first storage capacitor electrically connected between the first gate node of the second transistor and one of the electrodes of the organic light emitting diode, a seventh transistor electrically connected to the second gate node of the second transistor, and a second storage capacitor electrically connected between the second gate node of the second transistor and one of the source node and the drain node of the second transistor, diode-connecting between one of the source node and the drain node of the second transistor and the first gate node, and initializing one of the source node and the drain node of the second transistor and the first gate node to a driving voltage;

turning the sixth and fifth transistors on to apply a first initialization voltage to one of the source node and the drain node of the second transistor, and resetting one of the source node and the drain node of the second transistor to the first initialization voltage;

in a state in which the third transistor is turned on and the other of the source node and the drain node of the second transistor and the first gate node are diode-connected, turning the first transistor on to apply the data voltage to one of the source node and the drain node of the second transistor; and emitting the organic light emitting diode by a driving current of the second transistor corresponding to the data voltage.

7. The method of claim 6, wherein in the step of the initializing, the fourth transistor is turned on to apply a driving voltage to the other of the source node and the drain node of the second transistor and the first gate node, and the third transistor is turned on so that the other of the source node and the drain node of the second transistor and the first gate node are diode-connected.

8. The method of claim 6, wherein the first initialization voltage is equal to or lower than the data voltage corresponding to black data.

9. The method of claim 6, wherein one of the source node and the drain node of the second transistor reset to the first initialization voltage is the same node as the second gate node of the second transistor.

* * * * *